US005933115A

United States Patent [19]

Faraone et al.

[11] Patent Number: 5,933,115

[45] Date of Patent: Aug. 3, 1999

[54] PLANAR ANTENNA WITH PATCH RADIATORS FOR WIDE BANDWIDTH

[75] Inventors: Antonio Faraone; Quirino Balzano, both of Plantation; Oscar Garay, Coral Springs, all of Fla.

[73] Assignee: Motorola, Inc., Schaumburg, Ill.

[21] Appl. No.: 08/870,284

[22] Filed: Jun. 6, 1997

[51] Int. Cl.[6] ..... H01Q 1/38

[52] U.S. Cl. ..... 343/700 MS

[58] Field of Search ..... 343/700 MS; H01Q 21/08

[56] References Cited

U.S. PATENT DOCUMENTS

| | | | |
|---|---|---|---|
| 4,356,492 | 10/1982 | Kaloi | 343/700 MS |
| 4,755,821 | 7/1988 | Itoh et al. | 343/700 |
| 5,111,211 | 5/1992 | Dahlberg | 343/700 MS |
| 5,355,143 | 10/1994 | Zurcher et al. | 343/700 MS |
| 5,572,222 | 11/1996 | Mailandt et al. | 343/700 |
| 5,661,494 | 8/1997 | Bondyopadhyay | 343/700 MS |

FOREIGN PATENT DOCUMENTS

| | | | |
|---|---|---|---|
| 2 064 877 | 6/1981 | United Kingdom | H01Q 21/08 |

OTHER PUBLICATIONS

3Pozer, David M. "A review of Bandwidth Enhancement Techniques for Microstrip Antennas." in *Microstrip Antennas,* The Analysis and Design of Microstrip Antennas and Arrays, (New York, The Institute of Electrical and Electronics Engineers, 1995) pp. 157–166, TK7871.6.M512.

Popovic, Branko D., Jon Schoenberg, and Zoya Basta Popovic. "Broadband Quasi–Microstrip Antenna." *IEEE Transactions on Antennas and Propogation,* vol. 43, No. 10, (Oct. 1995). pp. 1148–1152.

*Primary Examiner*—Don Wong
*Assistant Examiner*—Hoang Nguyen
*Attorney, Agent, or Firm*—Andrew S. Fuller

[57] ABSTRACT

A microstrip antenna (100) achieves wider bandwidth by using an asymmetric radiating structure (110). The radiating structure (110) supports at least two resonating modes, which are preferably a differential and a common resonating mode. A feed system (130, 135) is coupled to the radiating structure (110) to excite the respective resonating modes at different frequencies to provide a radiating band for communication signals. Preferably, the antenna (100) includes patch radiators (112, 114) of substantially different widths, and a buried microstrip line (130) that simultaneously feeds the patch radiators (112, 114).

17 Claims, 2 Drawing Sheets

PLANAR ANTENNA WITH PATCH RADIATORS FOR WIDE BANDWIDTH

TECHNICAL FIELD

This invention relates in general to antennas, and more particularly, to planar antennas using patch radiators.

BACKGROUND OF THE INVENTION

Planar, microstrip antennas have characteristics often sought for portable communication devices, including advantages in cost, efficiency, size, and weight. However, such antennas generally have a narrow bandwidth which limits applications. Several approaches have been proposed in the art in an effort to widen the bandwidth of such structures. One such approach is described in U.S. Pat. No. 5,572,222 issued to Mailandt et al. on Nov. 5, 1996, for a Microstrip Patch Antenna Array. Here, a microstrip patch antenna is constructed using an array of spaced-apart patch radiators which are fed by an electromagnetically coupled microstrip line. Generally, with such structures, electromagnetic coupling between radiators is negligible, as it is regarded as a second-order undesired effect. Mailandt's structure is contemplated for use in fixed communication devices. For portable communication devices, size and weight considerations are paramount and such structures may not be suitable. Many other prior art approaches have similar drawbacks.

Current trends demand a reduction in size, weight, and cost for portable communication devices. Planar patch antennas could provide a part of the solution if bandwidth concerns are addressed without a significant compromise in size and weight. Moreover, these antennas can provide additional advantages in terms of directivity and efficiency. Therefore, a new approach for planar patch antenna with increased bandwidth is needed.

DETAILED DESCRIPTION OF THE PREFERRED EMBODIMENT

The present invention provides for a patch antenna, preferably of planar construction, that achieves a wide bandwidth using an asymmetric radiating structure. The radiating structure supports at least two resonating modes, which are preferably differential and common resonating modes. A feed system is coupled to the radiating structure to excite the respective resonating modes at different frequencies to provide a radiating band for communication signals. In the preferred embodiment, the radiating structure includes a grounded dielectric substrate that carries resonating structures, such as patch radiators, which have substantial electromagnetic coupling. The resonating structures are simultaneously fed to excite differential and common resonating modes which operate with a substantially similar effective dielectric constant. A common resonating mode exists for electromagnetically coupled resonating structures when current simultaneously travels on each resonating structure in substantially the same direction. A differential resonating mode exists for electromagnetically coupled resonating structures when current simultaneously travels on each resonating structure in a substantially opposite direction. The combination of the differential and common resonating modes produces a wide radiating band.

Figure 1:
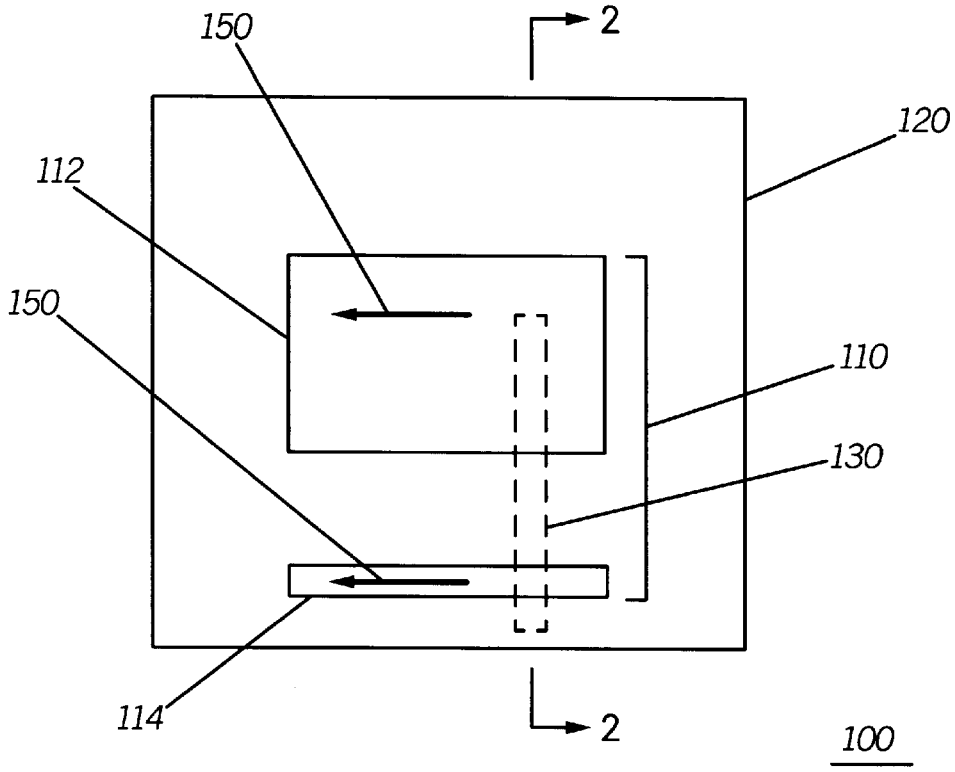
FIG. 1 is a top plan view of a patch antenna, in accordance with the present invention.
Figure 2:
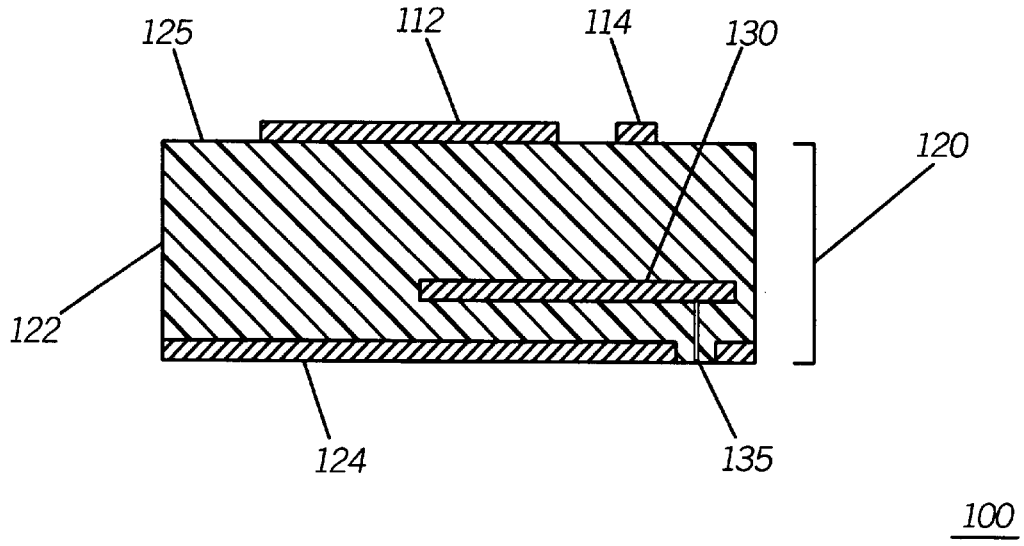
FIG. 2 is a cross-sectional view of the patch antenna of FIG. 1, in accordance with the present invention.

FIG. 1 is a top plan view of planar patch antenna 100, in accordance with the present invention. FIG. 2 is a cross-sectional view of the planar patch antenna 100. Referring to FIGS. 1 and 2, the planar patch antenna 100 comprises a grounded dielectric substrate 120, a radiating structure 110 carried or supported by the substrate 120, and a feed system 130, 135. The dielectric substrate 120 is formed by a layer of dielectric material 122, and a layer of conductive material 124 that functions as a ground plane. In the preferred embodiment, the dielectric material used is alumina substrate which has a dielectric constant of approximately ten (10). The feed system 130, 135 includes a buried microstrip line 130, disposed between the ground plane 124 and the radiating structure 110. A coaxial feed 135 is coupled to the microstrip line 130 to provide a conduit for communication signals.

The radiating structure 110 includes two patch radiators 112, 114 that form resonating structures, when excited by a feed signal. The patch radiators 112, 114 are preferably rectangular in geometry, having a length measured in a direction of wave propagation 150 (herein referred to as "resonating length"), and a width measured perpendicular to the resonating length. According to the present invention, the resonating structures form an asymmetric geometrical structure in which complementary resonating modes, such as differential and common modes, are presented within a particular operating frequency band. In the preferred embodiment, a primary radiator 112 is formed using a wide planar microstrip printed at the air-dielectric interface 125 of the grounded dielectric substrate 120. A secondary radiator 114 is formed from a narrow planar microstrip running parallel to the primary radiator. Preferably, the patch radiators have respective widths that differ by at least 50 percent. In the preferred embodiment, the narrower patch radiator has a width of at most 30 percent of that of the wider patch radiator. The patch radiators may also have a difference in resonating length for tuning purposes. The dimensions and placement of the patch radiator are significant aspects of the present invention. The patch radiators are placed such that there is a strong electromagnetic coupling between them. The asymmetric structure, i.e., the difference in width between the patch radiators, provide for distinct resonating modes with different phase velocities, and thus different resonant frequencies.

The resonating structures 112, 114 are dimensioned to have distinct resonating modes at frequencies that are close together, preferably within ten percent of each other. The result is an enhancement to the overall operational bandwidth for the antenna. The microstrip feed is positioned to apply a different excitation to each patch radiator. The overall excitation can be seen as a superposition of a differential mode excitation and a common mode excitation. The presence of the wide patch radiator produces a greater confinement of the electromagnetic energy within the substrate, both for the common and differential modes supported by the radiating structure. This results in differential and common resonating modes operating with a substantially similar effective dielectric constant, preferably within ten percent of each other. The substantial difference in width between radiators provides for asymmetry in the radiating structure and for the generation of the differential and common resonating modes that are used to effect a wide continuous radiating band.

In operation, the microstrip line 130 provides a signal that simultaneously excites the differential and common resonating modes of the radiating structure, with maximum excitation occurring at their respective resonating frequencies. In the preferred embodiment, the microstrip line 130 traverses under the narrow patch radiator and terminates at or near the wide patch radiator. This particular asymmetry produces a dominance in radiation of the greater current flowing on the wide radiator.

Thus, the present invention provides for an antenna with a radiating structure that supports at least two distinct radiating modes, such as differential and common radiating modes. A feed system is coupled to the radiating structure and excites the radiating modes at different frequencies to provide a radiating band for signal transmission. The feed system is preferably a microstrip line that simultaneously excites the distinct resonating modes within the resonating structures.

Figure 3:
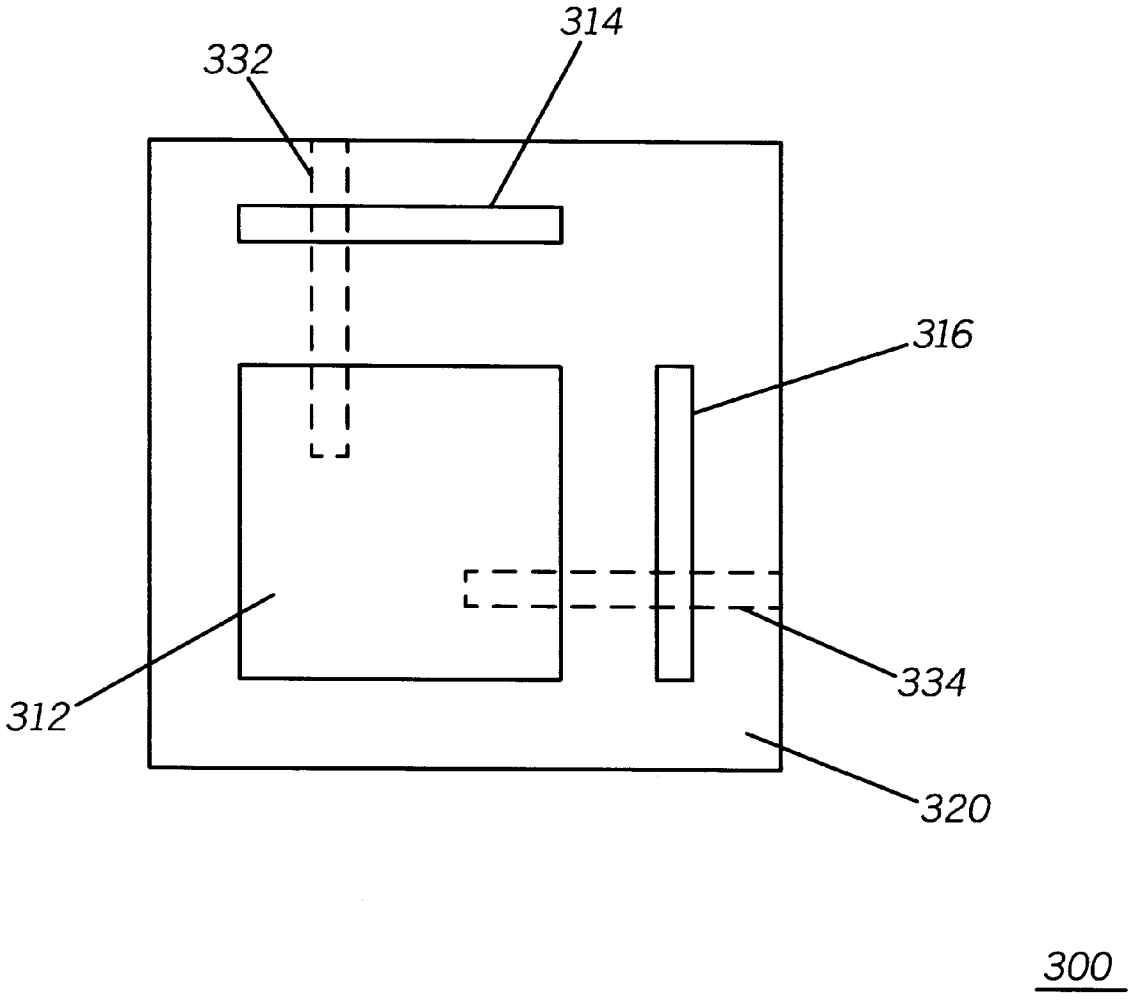
FIG. 3 is a top plan view of a patch antenna configuration that uses circular polarization, in accordance with the present invention.

FIG. 3 is a top plan view of a second embodiment of a planar patch antenna 300 having circular polarization, in accordance with the present invention. Here, three patch radiators 312, 314, 316 form a radiating structure that is disposed on a grounded dielectric substrate 320, and two microstrip lines 332, 334 provide orthogonal time quadrature feeds to the patch radiators 312, 314, 316. As before, the patch radiators combine to form an asymmetrical geometrical structure that generates distinct resonating modes with a substantially similar effective dielectric constant. A first narrow patch radiator 314 is situated proximate to a wide patch radiator 312 such that there is substantial electromagnetic coupling therebetween. Both radiators 312, 314 are fed by a buried microstrip line that traverses under the narrow patch radiator 314 and terminates under the wide patch radiator 312. A second narrow patch radiator 316 is situated proximate to the wide patch radiator but oriented orthogonal to the first narrow patch radiator. Another microstrip line 334 traverses the narrow patch radiator 316 and terminates under the wide patch radiator 312.

The principles of the present invention may be used to form a variety of antenna structures of varying configurations that yield a substantial improvement in operational bandwidth. For example, the relative positioning of wide and narrow patch radiators may be interchanged to form other useful configurations. By utilizing an asymmetrical geometry that presents differential and common resonating modes to expand bandwidth, planar patch antennas can be incorporated in portable communication devices to yield reductions in size, weight, and cost, and improvements in directivity and efficiency.

What is claimed is:

1. A planar antenna operable in a particular operating frequency band, comprising:

a dielectric substrate;

first and second patch radiators have substantial electromagnetic coupling to each other and that are supported by the substrate, the first and second patch radiators forming an asymmetrical structure in which complementary differential and common modes are presented within the particular operating frequency band; and a microstrip line carried by the substrate, the microstrip line being electromagnetically coupled to both the first and second patch radiators to provide a feed system;

wherein the first and second patch radiators are adjacent to each other and have a difference in width, with respect to the direction of traversal of the microstrip line, of at least 50 percent.

2. The planar antenna of claim 1, further comprising a ground plane disposed on the substrate, wherein the microstrip line is embedded within the dielectric substrate between the ground plane and the first and second patch radiators.

3. The planar antenna of claim 1, wherein the first and second patch radiators are responsive to a signal on the microstrip line to generate common and differential resonating modes with a substantially similar effective dielectric constant.

4. A planar antenna operable in a particular operating frequency band, comprising:

a dielectric substrate;

first and second patch radiators have substantial electromagnetic coupling to each other and that are supported by the substrate, the first and second patch radiators forming an asymmetrical structure in which complementary differential and common modes are presented within the particular operating frequency band, wherein the first patch radiator has a width of at most 50 percent of that of the second patch radiator, and the microstrip line traverses one of the first and second patch radiators and terminates under the other of the first and second patch radiators;

a microstrip line carried by the substrate, the microstrip line being electromagnetically coupled to both the first and second patch radiators to provide a feed system; and a ground plane disposed on the substrate, wherein the microstrip line is embedded within the dielectric substrate between the ground plane and the first and second patch radiators.

5. A planar antenna comprising a grounded dielectric substrate carrying first and second adjacently positioned resonators that have substantial electromagnetic coupling to each other, and that are simultaneously fed to excite differential and common radiating modes that operate together to produce a continuous radiating band, wherein the first and second patch radiators have first and second widths, respectively, the first and second widths having a percentage difference of at least 50 percent.

6. The planar antenna of claim 5, wherein the first and second resonator structures comprise first and second patch radiators, respectively, that have asymmetrical geometries selected to form a combined structure that resonates at substantially close frequencies in the differential and common radiating modes.

7. The planar antenna of claim 6, further comprising a buried microstrip line carried by the substrate, the microstrip line being electromagnetically coupled to the first and second patch radiators to provide a feed system.

8. The planar antenna of claim 7, wherein the substrate comprises a ground plane, and the microstrip line is positioned between the ground plane and the first and second patch radiators.

9. A planar antenna comprising a grounded dielectric substrate carrying first and second resonators that have substantial electromagnetic coupling to each other, and that are simultaneously fed to excite differential and common radiating modes that operate together to produce a continuous radiating band, and further comprising a buried microstrip line carried by the substrate, the microstrip line being electromagnetically coupled to the first and second patch radiators to provide a feed system, wherein:

the first and second resonator structures comprise first and second patch radiators, respectively, that have asymmetrical geometries selected to form a combined structure that resonates at substantially close frequencies in the differential and common radiating modes; and the first patch radiator has a width of at most 30 percent of that of the second patch radiator, and the microstrip line traverses the one of the first and second patch radiators and terminates at or near the other of the first and second patch radiators.

10. An antenna, comprising:

a grounded dielectric substrate;

first and second patch radiators adjacently positioned on the dielectric substrate and having a substantial electromagnetic coupling therebetween, each of the first and second having a geometry selected to have, in combination, differential and common resonating modes operating with a substantially similar effective dielectric constant, the first and second patch radiators each having a direction of wave propagation, and each having a substantial difference in width of at least 50 percent measured in a direction perpendicular to the direction of wave propagation; and a feed system coupled to the first and second resonating structures and operable to provide a signal to simultaneously excite the differential and common resonating modes.

11. The antenna of claim 10, wherein the feed system comprises a buried microstrip line.

12. The antenna of claim 11, wherein the dielectric substrate comprises a ground plane and the buried microstrip line is disposed between the ground plane and the first and second patch radiators.

13. The antenna of claim 10, wherein the first and second patch radiators have a difference in resonating length.

14. The antenna of claim 10, wherein the first and second patch radiators are simultaneously fed by the buried microstrip line.

15. An antenna comprising:

radiating structure that supports at least two distinct radiating modes, the radiating structure comprising:

a grounded dielectric substrate;

first and second resonating structures carried by the dielectric substrate and having a substantial electromagnetic coupling therebetween, each of the first and second resonating structures having a geometry selected to have, in combination, first and second distinct resonating modes operating with a substantially similar effective dielectric constant; and a third resonating structure carried by the dielectric substrate and electromagnetically coupled to the second resonating structure;

a feed system coupled to the radiating structure that excites the at least two distinct radiating modes at different frequencies to provide a radiating band for signal transmission, wherein the feed system comprises orthogonal time quadrature feeds that are coupled to the first, second, and third resonating structures.

16. The antenna of claim 15, wherein:

the first, second, and third resonating structures comprise first, second, and third patch radiators, respectively;

the feed system comprises a first microstrip line that traverses the first patch radiator and terminates under the second patch radiator; and the feed system comprises a second microstrip line that traverses the third patch radiator and terminates under the second patch radiator.

17. The antenna of claim 15, wherein the first and second distinct resonating modes comprise a differential and a common resonating mode, respectively.

* * * * *